United States Patent [19]

Bittar

[11] Patent Number: 4,815,568

[45] Date of Patent: Mar. 28, 1989

[54] WEIGHTED RELATIVE SYSTEM RESPONSE ELEVATOR CAR ASSIGNMENT SYSTEM WITH VARIABLE BONUSES AND PENALTIES

[75] Inventor: Joseph Bittar, Avon, Conn.

[73] Assignee: Otis Elevator Company, Farmington, Conn.

[21] Appl. No.: 192,436

[22] Filed: May 11, 1988

[51] Int. Cl.[4] ..... B66B 1/18

[52] U.S. Cl. ..... 187/127

[58] Field of Search ..... 187/124, 125, 127

[56] References Cited

U.S. PATENT DOCUMENTS

| | | | |
|---|---|---|---|
| 4,305,479 | 12/1981 | Bittar et al. | 187/125 |
| 4,363,381 | 12/1982 | Bittar | 187/127 |
| 4,448,286 | 5/1984 | Kuzunuki et al. | 187/127 |
| 4,523,665 | 6/1985 | Tsuji | 187/127 |

*Primary Examiner*—William M. Shoop, Jr.
*Assistant Examiner*—W. E. Duncanson, Jr.

[57] ABSTRACT

An elevator control system employing a micro-processor-based group controller (FIG. 2) which communicates with the cars (3, 4) of the elevator system to determine conditions of the cars and responds to hall calls registered at a plurality of landings in the building serviced by the cars under control of the group controller, to provide assignments of the hall calls to the cars based on the summation for each car, with respect to each call, a weighted summation of a plurality of system response factors, some indicative, and some not, of conditions of the car irrespective of the call to be assigned, assigning "bonuses" and "penalties" to them in the weighted summation. In the invention, rather than a set of unvarying bonuses and penalties being assigned based on the relative system response factors, the assigned bonuses and penalties are varied based on the perceived intensity of traffic, as measured by, for example, a past average waiting time and the elapsed time since registration of the hall call, a selected past five minute average waiting time being exemplary. Exemplary apparatus (FIGS. 1 and 2) and a logic flow diagram (FIG. 3) illustrate a specific manner of assigning calls to cars. Tables set forth exemplary varying bonus and penalty values to be assigned, depending on the ratio of the hall call registration time to the selected average hall call waiting time (Tables 1 and 2) or on their differences (Table 3).

21 Claims, 3 Drawing Sheets

WEIGHTED RELATIVE SYSTEM RESPONSE ELEVATOR CAR ASSIGNMENT SYSTEM WITH VARIABLE BONUSES AND PENALTIES

TECHNICAL FIELD

The present invention relates to elevator systems and to controlling cars to be dispatched in an elevator system. More particularly the invention relates to the assignment of hall calls to a selected one of a group of elevators serving floor landings of a building in common, based on weighted relative system response (RSR) considerations.

These RSR considerations include factors which take into account system operating characteristics in accordance with a scheme of operation which includes a plurality of desirable factors, the assignments being made based upon a relative balance among the factors, in essence assigning "bonuses" and "penalties" to the cars in determining which cars are to be assigned to which hall calls through a computer algorithm.

Even more particularly, the present invention relates to controlling cars to be dispatched based on a dispatcher algorithm with variable bonuses and penalties based on the current intensity of traffic as measured by a recent average, for example, the past five (5) minute average.

BACKGROUND ART

As elevator systems have become more sophisticated, for instance having a large number of elevators operating as a group to service a large number of floors, a need developed for determining the manner in which calls for service in either the up or down direction registered at any of the floor landings of the building are to be answered by the respective elevator cars. The most common form of elevator system group control divides the floors of the building into zones, there being one or several floors in each zone, with approximately the same number of zones as there are cars in the elevator system which can respond to group-controlled service of floor landing calls. However, this approach has had a number of drawbacks.

A more recent innovation, described in the commonly owned U.S. Pat. No. 4,363,381 of Joseph Bittar issued Dec. 14, 1982, included the provision of an elevator control system in which hall calls are assigned to cars based upon relative system response (RSR) factors, which take into account instantaneous system operating characteristics in accordance with a desirable scheme of operation. This scheme includes considering a plurality of desirable factors, the assignments being made based upon a relative balance among the factors in making the ultimate selection of a car to answer a hall call. The previous Bittar invention thus provided a capability of assigning calls on a relative basis, rather than on an absolute basis, and, in doing so, used specific, pre-set values for assigning the RSR "bonuses" and "penalties".

As conditions changed, the factors changed by a preset amount, so the relative system response factor summation for each car with respect to any call would change similarly. And, system operational factors such as, for example, preventing unnecessary motion of a car, saving energy by allowing cars to remain shut down unless really needed, favoring the availability of cars at a main landing such as a lobby, were all factored in, not absolutely, but based upon the reasonableness of creating delay in answering calls in exchange for a continued system operational pattern which was realistic and served other needs.

However, on the other hand, the relative system response (RSR) algorithm disclosed in the prior Bittar '381 patent used particular, preset bonuses and penalties and calculated RSR value as a function of these particular set bonuses and penalties. For each hall call that was currently registered in the group, the RSR value was computed for each car. The car having the lowest RSR value was assigned to answer the hall call, and this procedure was repeated for each hall call.

But, because the bonuses and penalties were fixed and preselected, waiting times sometimes became large, depending on the circumstances of the system. Thus, although the '381 invention was a substantial advance in the art, further substantial improvement is possible and has been achieved in the present invention.

DISCLOSURE OF INVENTION

Thus, a primary object of the present invention is to use bonuses and penalties to even out the waiting times and greatly reduce, if not eliminate, large waiting times and service times in a multi-car elevator system.

In the present invention the bonuses and penalties are varied, rather than preselected and fixed as in the prior Bittar '381 invention, as functions or special characteristics, for example, of recently past average waiting time and current hall call registration time, which can be used to measure the relatively current intensity of the traffic in the building. An exemplary average time period which can be used is five (5) minutes, and a time period of that order is preferred.

The hall calls are assigned to the cars, when they are received, using initial values of the bonuses and penalties to compute the RSR values.

During system operation, the average hall call waiting time for the selected past time period is estimated using, for example, the clock time at hall call registration and the hall call answering time for each hall call and the total number of hall calls answered during the selected time period. The hall call registration time of a specified hall call is computed, knowing the time when the hall call was registered and the current clock time when the hall call is to be assigned. According to the invention, the penalties and bonuses are selected, so as to give preference to the hall calls that remain registered for a long time, relative to the past selected period's average waiting time of the hall calls.

When the hall call registration time is small compared to the selected time period's average waiting time, the hall call can wait, for example, for a coincident car call stop or a contiguous stop. Likewise, for further example, it can also wait for a car having less than the maximum allowable number of calls assigned to it, having motor generator (MG) set on and not parked. Thus, for these situations, the bonuses and penalties will be varied for them by increasing them.

The functional relationship used to select the bonuses and penalties relates, for example, the ratio of hall call registration time to the average past selected time period's hall call waiting time to the increases in the values of the bonuses and penalties.

When the hall call registration time is large compared to the past selected time period's average wait time, then the call should have high priority and thus should not wait for, for example, cars having a coincident car call stop or a contiguous stop and should not wait for cars having less than the allowable number of cars assigned, MG set on and not parked. Thus, for these situations, the bonuses and penalties will be varied by decreasing them.

As a variant to the foregoing, the bonuses and penalties can be decreased or increased based on the difference between the current hall call registration time and the past selected time period's average hall call waiting time as a measure of current traffic intensity.

As a further variant, the past selected time period's average is computed as before. If this is less than some selected value, this indicates a light traffic load, and there is no need to use, for example, coincident car calls or contiguous stops. Accordingly, the bonuses and penalties may be reduced. On the other hand, if the average is more than the selected value, then the bonuses and penalties may by increased from the nominal values, and the correspondingly varied bonuses and penalties used for the initial values.

The invention may be practiced in a wide variety of elevator systems, utilizing known technology, in the light of the teachings of the present invention which are further detailed hereinafter. The foregoing and other objects, features and advantages of the present invention will become more apparent in the light of the following detailed description of an exemplary embodiment thereof, as illustrated in the accompanying drawing(s).

BRIEF DESCRIPTION OF DRAWINGS

FIG. 1 is a simplified, schematic block diagram, partially broken away, of an exemplary elevator system in which the present invention may be incorporated; while

BEST MODE FOR CARRYING OUT THE INVENTION

Exemplary Application

For the purposes of detailing an exemplary application of the present invention, the disclosures particularly of the prior Bittar U.S. Pat. No. 4,363,381, as well as of a related, commonly owned U.S. Pat. No. 4,305,479 of said Bittar and one Arnold Mendelsohn, issued Dec. 15, 1981, entitled "Variable Elevator Up Peak Dispatching Interval", are incorporated herein by reference.

The preferred application for the present invention is in an elevator control system employing a microprocessor-based group controller using signal processing means, which communicates with the cars of the elevator system to determine the conditions of the cars and responds to hall calls registered at a plurality of landings in the building serviced by the cars under control of the group controller, to provide assignments of the hall calls to the cars based on the summation for each car, with respect to each call, a weighted summation of a plurality of system response factors indicative of various conditions of the car irrespective of the call to be assigned, as well as indicative of other conditions of the car relative to the call to be assigned, assigning "bonuses" and "penalties" to them in the weighted summation. An exemplary elevator system and an exemplary car controller (in block diagram form) are illustrated in FIGS. 1 and 2, respectively, of the '381 patent and described in detail therein.

Figure 1:
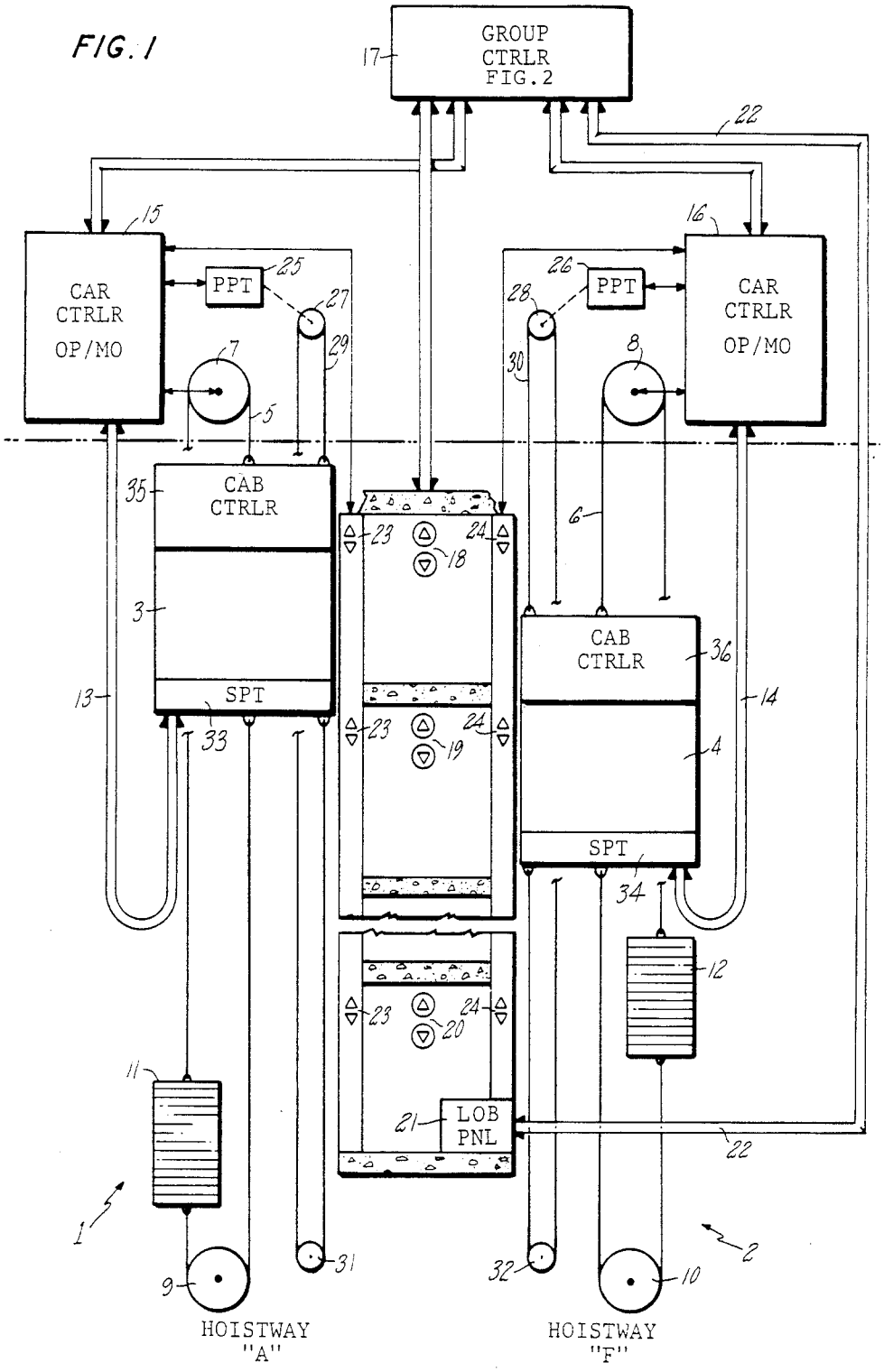
Figure 2:
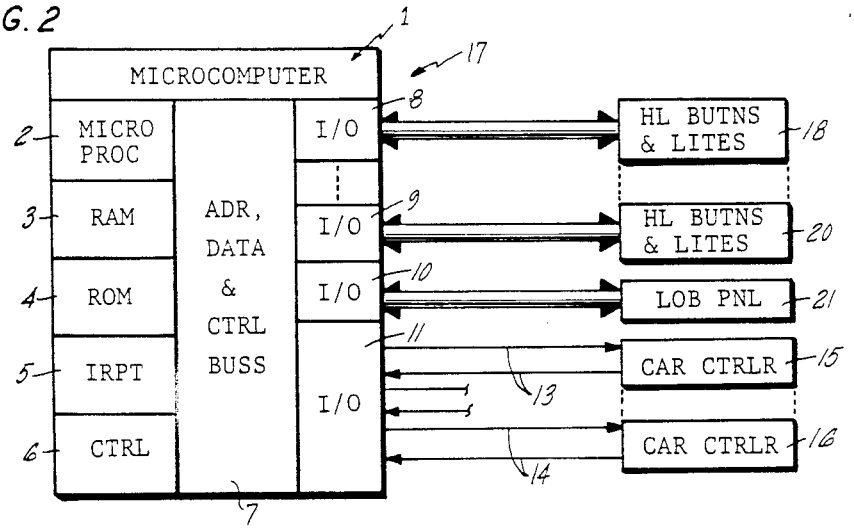
FIG. 2 is a simplified, schematic block diagram of an exemplary car controller, which may be employed in the system of FIG. 1, and in which the invention may be implemented.

It is noted that FIGS. 1 and 2 hereof are substantively identical to the same figures of the '381 patent. For the sake of brevity the elements of FIGS. 1 and 2 are merely outlined or generally described below, while any further, desired operational detail can be obtained from the '318 patent.

In FIG. 1, a plurality of exemplary hoistways, HOISTWAY "A" 1 and HOISTWAY "F" 2 are illustrated, the remainder not being shown for simplicity purposes. In each hoistway, an elevator car or cab 3, 4 is guided for vertical movement on rails (not shown).

Each car is suspended on a steel cable 5, 6, that is driven in either direction or held in a fixed position by a drive sheave/motor/brake assembly 7, 8, and guided by an idler or return sheave 9, 10 in the well of the hoistway. The cable 5, 6 normally also carries a counterweight 11, 12, which is typically equal to approximately the weight of the cab when it is carrying half of its permissible load.

Each cab 3, 4 is connected by a traveling cable 13, 14 to a corresponding car controller 15, 16, which is typically located in a machine room at the head of the hoistways. The car controllers 15, 16 provide operation and motion control to the cabs, as is known in the art.

In the case of multi-car elevator systems, it has long been common to provide a group controller 17, which receives up and down hall calls registered on hall call buttons 18–20 on the floors of the buildings and allocates those calls to the various cars for response, and distributes cars among the floors of the building, in accordance with any one of several various modes of group operation. Modes of group operation may be controlled in part, for example, by a lobby panel (LOB PNL) 21, which is normally connected by suitable building wiring 22 to the group controller in multi-car elevator systems.

The car controllers 15, 16 also control certain hoistway functions, which relate to the corresponding car, such as the lighting of "up" and "down" response lanterns 23, 24, there being one such set of lanterns 23 assigned to each car 3, and similar sets of lanterns 24 for each other car 4, designating the hoistway door where service in response to a hall call will be provided for the respective up and down directions.

The foregoing is a description of an elevator system in general, and, as far as the description goes thus far, is equally descriptive of elevator systems known to the prior art, as well as an exemplary elevator system which could incorporate the teachings of the present invention.

Although not required in the practice of the present invention, the elevator system in which the invention is utilized may derive the position of the car within the hoistway by means of a primary position transducer (PPT) 25, 26. Such a transducer is driven by a suitable sprocket 27, 28 in response to a steel tape 29, 30, which is connected at both of its ends to the cab and passes over an idler sprocket 31, 32 in the hoistway well.

Similarly, although not required in an elevator system to practice the present invention, detailed positional information at each floor, for more door control and for verification of floor position information derived by the PPT 25, 26, may employ a secondary position transducer (SPT) 33, 34. Or, if desired, the elevator system in which the present invention is practiced may employ inner door zone and outer door zone hoistway switches of the type known in the art.

All of the functions of the cab itself may be directed, or communicated with, by means of a cab controller 35, 36 in accordance with the present invention, and may provide serial, time-multiplexed communications with the car controller, as well as direct, hard-wired communications with the car controller by means of the traveling cables 13 and 14. The cab controller, for instance, can monitor the car call buttons, door open and door close buttons, and other buttons and switches within the car. It can also control the lighting of buttons to indicate car calls and provide control over the floor indicator inside the car, which designates the approaching floor.

The cab controller interfaces with load weighing transducers to provide weight information used in controlling the motion, operation, and door functions of the car. A most significant job of the cab controller 35, 36 is to control the opening and closing of the door, in accordance with demands therefore, under conditions which are determined to be safe.

The makeup of microcomputer systems, such as may be used in the implementation of the car controllers 15, 16, a group controller 17, and the cab controllers 35, 36, can be selected from readily available components or families thereof, in accordance with known technology as described in various commercial and technical publications. The software structures for implementing the present invention, and peripheral features which may be disclosed herein, may be organized in a wide variety of fashions.

Referring now to FIG. 2, a group controller 17 is illustrated simply, in a very general block form. The group controller is based on a microcomputer 1, which may take any one of a number of well-known forms. For instance, it may be built up of selected integrated circuit chips offered by a variety of manufacturers in related series of integrated circuit chips. Such a microcomputer 1 may typically include a microprocessor (a central control and arithmetic and logic unit) 2, random access memory (RAM) 3, read only memory (ROM) 4, an interrupt priority and/or decode circuit (IRPT) 5, and control circuits (CTRL) 6, such as address/operation decodes and the like.

The microcomputer 1 is generally formed by an assemblage of chips 2–6 on a board, with suitable plated or other wiring, so as to provide adequate address, data, and control busses (ADR, DATA & CTRL BUSS) 7, which interconnect the chips 2–6 with a plurality of input/output (I/O) modules of a suitable variety 8–11. The nature of the I/O modules 8–11 depends on the functions which they are to control. It also depends, in each case, on the types of interfacing circuitry, which may be utilized outboard therefrom, in controlling or monitoring the elevator apparatus to which the I/O is connected. For instance, the I/Os 8–10, being connected to lobby and hall call buttons and lamps and to switches and indicators, may simply comprise buffered input and buffered output, multiplexer and demultiplexer, and voltage and/or power conversion and/or isolation so as to be able to sense hall or lobby panel button or switch closure and to drive lamps with a suitable power, whether the power is supplied to the I/O or externally. As noted in FIG. 2, the I/Os 8 and 9 can be connected to the hall buttons and lights (HL BUTNS & LITES) 18–20 (also FIG. 1), while I/O 10 is connected to the lobby panel (LOB PNL) 15 (also FIG. 1).

The I/O module 11 provides serial communication over current loop lines 13, 14 (FIG. 2) with the car controllers 15, 16 (FIGS. 1 and 2). These communications include commands from the group controller to the cars, such as for example higher and lower demand, stop commands, cancelling hall calls, preventing lobby dispatch and other commands relating to optional features, such as express priority and the like. The group controller initiates communication with each of the car controllers in succession, and each communication operation includes receiving response from the car controller, such as in the well known "handshake" fashion, including car status and operation information, such as, is the car in the group, is it advancing up or down, its load status, its position, whether it is under a go command or is running, whether its door is fully open or closed, and other conditions.

As described herein before, the meanings of the signals which are not otherwise explained hereinafter, the functions of the signals which are not fully explained hereinafter, and the manner of transferring and utilizing the signals, which are not fully described hereinafter, are all within the skill of the elevator and signal processing arts, in the light of the teachings herein and/or the prior art. Therefore, detailed description of any specific apparatus or mode of operation thereof to accomplish these ends is unnecessary and not included herein.

RSR Assignment of Prior '381 Patent

As noted in the '381 patent, the assignment of calls to cars, utilizing relative system response factors, may take a variety of forms. The exemplary ones given in the '381 patent are incorporated herein as providing an exemplary initial set of starting bonuses and penalties.

As described in said '381 patent, both the relative system response factor and the run times which might be used as components of the relative system response factor, may be expressed in seconds, and the penalties for response are therefore in terms of degraded performance relative to whether a particular car should answer any particular call, in contrast with the relative system response factor for other cars. The '381 invention thereby provided the ability to put relative penalties on factors, such as not starting motor generator sets or preference t lobby service, which have nothing to do with the speed of reaching a particular hall call. What these response factors did was to balance the desire for certain system responses characteristics against the need to service calls rapidly and the need to provide other desirable response characteristic.

In some cases, the relative response factor was an indication of the anticipated ability of a car to handle the call and deliver the passenger to his ultimate destination, which might have been compared with the overall response factors of other cars. For instance, in FIG. 7 of the '381 patent, step 22 was an indication of a penalty against a car if it had more than six car calls, because this was an indication of the business load of the car, and the likelihood that the particular passenger (whose hall call is now being assigned to a car) would not be delivered to his destination as quickly, if a car had more than six car calls. This had nothing to do with the length of time it would take to pick up that passenger, since that time is calculated in the door time and run time routines of FIGS. 9 and 10 of the '381 patent.

In FIG. 7 of the '381 patent, step 11 penalized a car for not running. But it did not prevent such car from answering a call. What it said was that everything else being equal, unless a passenger would have to wait an additional exemplary twenty seconds for some other car to answer it, that car would not start up just to answer a single hall call.

And, all of the response factors were relative, except for those which were indicative of a general inability of a car to answer a call at all. For instance, if a car was indicated as being full, it was not prevented from answering the call, unless it was not going to stop at the floor where the call in consideration had been registered. But even then, it was not automatically given that call simply because it must stop there anyway. It might not have been able to get to that call for a minute or more; and it might have still been full when it got there. Therefore, only a relative penalty for it being full was given to it, if it was going to stop at the floor, and this was less than the favorable award of the minus twenty seconds given to such a car in FIG. 11 of the '381 patent.

At the bottom of FIG. 7 of the '381 patent, considerations relating to preferential lobby service were made. Even though response to a hall call might be delayed, the lobby (or other main landing) was given certain preferences, since it is was known that the lobby must be served on a regular basis. And these preferences were, however, not absolute, but only relative. Thus, step 20 provided an exemplary twelve second penalty, if the call in consideration was not at the lobby, but the car in consideration had been assigned a lobby call. This provided faster service to the lobby, where accumulated passengers were undesirable.

On the other hand, if the car in question had no other calls, but was assigned to the lobby, the penalty was greater (being for example fifteen seconds in step 16 in contrast with twelve seconds in step 20). But if the car had no other calls and was not assigned to the lobby, then the penalty was only for example eight seconds, as set in step 14. The result of these various penalty factors was that the overall desires of an operating system, rather than a single parameter (how quickly could a car get to a call), were given paramount consideration in the relative response determinations being made.

The amount of time that a car might take in order to reach a hall call was estimated in the door time and run time routines of FIGS. 9 and 10 of the '381 patent. FIG. 9 took care of a current stop, which the car might have been initiating or finishing, and FIG. 10 accounted for running time and gross stopping time at stops, which would later be encountered during the run. But there again, there was a difference in the relative response time, since it depended upon the actual status of the car being considered in the door time routine of FIG. 9, and since different run times were added in for stops which resulted form hall calls than for stops which resulted from car calls in steps 12 and 13 of FIG. 10.

In FIG. 11 of the '381 patent, the fact that the car was placed already set to stop at the floor under consideration was given great weight by subtracting, for example, twenty seconds from the relative response factor. This differed from then prior systems, which would make an absolute assignment of that call to that car. Energy savings (though perhaps not time to respond to the call) were reflected in the '381 patent in the fact that a fully loaded car might answer the call, or it might not, depending upon whether other cars could get there within some penalty factor, such as for example fourteen seconds; in the fact that cars were penalized for having their motor generator sets off, and therefore would be started up only when needed to give good building service; in the fact that the lobby (or other main landing) was given certain preferences so that special lobby service need not have to be initiated later, since it could be accommodated in the overall plan of response that cars that were at the lobby would tend to stay at the lobby if they had no calls, because a penalty of for example fifteen seconds was given to them; this no only provided favored lobby service, but avoided the need for special start-ups for lobby service, which could always be anticipated as a part of future demand on any elevator system. Any other car which had no calls at all, and was simply resting at a floor, was given a small penalty, since it might be able to come to rest if some other car took over the call under question (step 14 of FIG. 7 of the '381 patent). And unnecessary stops were avoided, if a car could not save for example twenty seconds of waiting time, by favoring a car which might have been able to service the car directly (step 3, FIG. 11 of the '381 patent).

Again, all of the foregoing represent innovative teachings of the '381 patent and are being cited here for background to best understand the innovations of the present invention, which will now be described in the context of the foregoing exemplary application.

Exemplary Variable Bonus/Penalty Algorithm Of Invention

Figure 3:
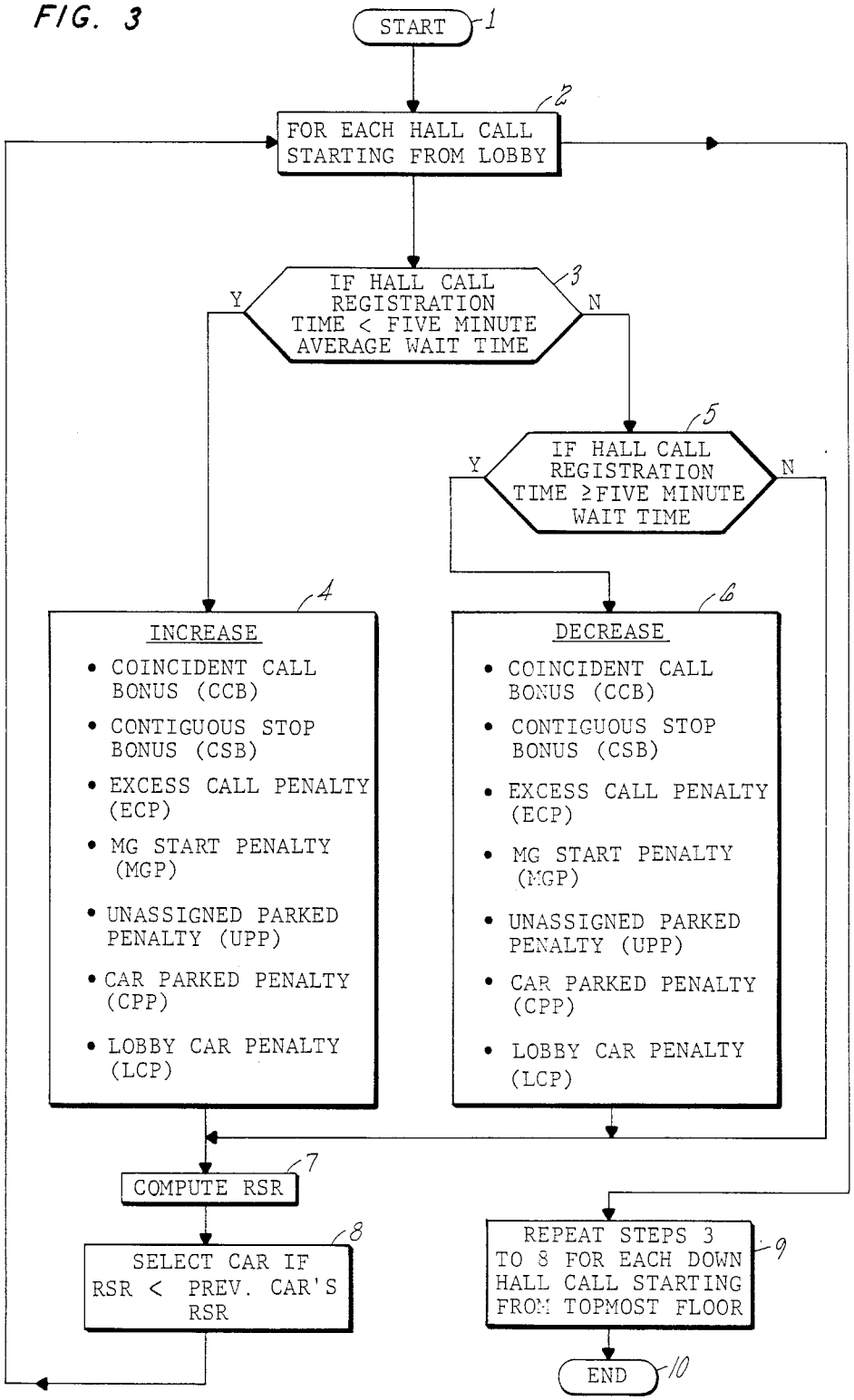
FIG. 3 is a simplified, logic flow diagram for the exemplary algorithm for varying the bonuses and penalties used in the preferred, exemplary embodiment of the present invention.

In contrast to the unvarying set of RSR values in the '381 invention, the exemplary RSR algorithm of the present invention uses variable "bonuses" and "penalties" preferably based on measures of traffic intensity, and the simplified logic flow diagram of the exemplary algorithm of the present invention is illustrated in FIG. 3.

In the exemplary embodiment hereof, as a measure of traffic intensity, during system operation the average hall call waiting time for a reasonably selected past time period, for example, the past five (5) minute period, is computed, using the clock time at hall call registration and the hall call answering time for each hall call, and the total number of hall calls answered during the selected five (5) minute time period.

The hall call registration time of a specified hall call is computed, knowing the time when the hall call was registered and the current clock time when the hall call is to be assigned.

As will be explained in detail below, a comparison is made between the average past five (5) minute waiting time and the hall call registration time based on a selected relationship. In the initial embodiment this comparison is based on a ratio of the former to the latter, while in a further embodiment the comparison is based on the difference between the two. These comparisons provide traffic intensity measuring means for measuring the current traffic intensity of the elevator system.

In the preferred embodiment the penalties and bonuses are selected, so as to give preference to the hall calls that remain registered for a long time, relative to, for example, the past five (5) minutes average waiting time of the hall calls.

When the hall call registration time is small compared to the five (5) minute average wait time, the hall call can wait for a car with a coincident car call (CC) stop or a contiguous stop (CS). It can also wait for a car having less than the maximum allowable number of calls assigned to it, having its motor generator (MG) set on and not parked. Therefore, the assigned values for the bonuses and penalties are increased for all of the cars in these situations.

In the initial exemplary embodiment the functional relationship used to select the amount of increases for the bonuses and penalties relates the ratio of the hall call registration time ($t_{HCR}$) to the average past five (5) minute hall call waiting time ($t_{HCW}$) to the increases in the values of the bonuses and penalties. A typical or exemplary relationship is outlined in the following Table 1.

TABLE 1

| | Increase in Values of Bonuses and Penalties | | | | | | |
|---|---|---|---|---|---|---|---|
| $t_{HCR}/t_{HCW}$ | CCB | CSB | ECP | MGP | UPP | CPP | LCP |
| ≦0.1 | +8 | +6 | +6 | +8 | +8 | +6 | +6 |
| ≦0.2 | +6 | +5 | +5 | +6 | +6 | +5 | +5 |
| ≦0.5 | +4 | +3 | +3 | +4 | +4 | +4 | +4 |
| ≦0.7 | +2 | +2 | +2 | +2 | +2 | +3 | +3 |
| ≦0.9 | +1 | +1 | +1 | +1 | +1 | +2 | +2 |
| ≦1.0 | +0 | +0 | +0 | +0 | +0 | +0 | +0 |

where "CCB" is the bonus for a car having a coincident call, "CSB" is the bonus for a car having a contiguous stop, "ECP" is the penalty for a car with excess calls, "MGP" is the penalty for a car having its motor generator off, "UPP" is the penalty for a car which is unassigned and parked, "CPP" is the penalty for a car which is parked, and "LCP" is the penalty for a lobby call.

Thus, as a single example from the above table, for a ratio of the hall call registration time to the average past five minutes hall call waiting time of less than one-tenth, a car with a coincident call (CC) has its RSR bonus (B) value increased by eight, etc.; while for a ratio value of one, no change in value is made for any of the cars. This cut off or change over point of a ratio of about one is considered preferred.

On the other hand, when the current hall call registration time is large compared to the past five (5) minutes average wait time, with a correspondingly higher ratio greater than one, then the call should have high priority and therefore should not wait for cars having a coincident car call (CC) stop or a contiguous stop (CS) and should not wait for cars having less than the allowable number of calls assigned, MG set on or not parked. Thus, in the exemplary embodiment, the values for the bonuses and penalties for these are decreased. The exemplary functional relationship used to select the decreases in the values of the bonuses and penalties as functions of the ratio of current hall call registration time to the past five (5) minutes average wait time is shown in Table 2 below.

TABLE 2

| | Decreases in Values of Bonuses and Penalties | | | | | | |
|---|---|---|---|---|---|---|---|
| $t_{HCR}/t_{HCW}$ | CCB | CSB | ECP | MGP | UPP | CPP | LCP |
| ≦1.5 | −5 | −1 | −1 | −1 | −1 | −1 | −1 |
| ≦2.5 | −10 | −2 | −2 | −2 | −2 | −2 | −2 |
| ≦3.0 | −15 | −4 | −3 | −4 | −4 | −3 | −4 |
| ≦5.0 | −20 | −6 | −4 | −6 | −6 | −6 | −6 |
| >5.0 | −20 | −8 | −5 | −8 | −8 | −5 | −8 |

Thus, for a single example from the foregoing table, for a ratio of less than one-and-one-half, a car with a coincident call has its bonus value decreased by a value of five, etc.; while, for a ratio in excess of five, a car that is at the lobby (LC) has its penalty value decreased by a value of eight, etc. As an alternative, for ratios greater than five, the values of CCB through LCP in Table 2 could have nominal values selected.

Hence, as can be seen from Tables 1 and 2, for ratios of less than one, the values of the assigned bonuses and penalties are increased, while, for ratio of more than one, the values of the assigned bonuses and penalties are decreased.

If desired, other optimal values for the increases and decreases for any particular application or for general application can be determined using, for example, detailed computer simulation, in place of the exemplary varying values presented in Tables 1 and 2.

Thus, with particular reference to the simplified logic flow diagram of FIG. 3, a start routine Step 1 is run, in which all pertinent RAM memory is cleared. For each "up" hall call starting from the lobby and going up (Step 2), if the hall call registration time is less than the past five minute average waiting time for all hall calls determined in Step 3, then the assigned bonuses and penalties for each car (for each hall call) is increased in Step 4 by the values in Table 1. It is noted that the particular set of increases in the values of the bonuses and penalties assigned in the preferred, exemplary embodiment is further based on how much greater the past five minute average waiting time is than the hall call registration time (ratios of less than one). This latter is determined in a sub-routine not illustrated for simplicity purposes, the details of which would be known to one of ordinary skill in the art.

On the other hand, if the hall call registration time is equal to or greater than the past five minute average waiting time, then a further evaluation is made with respect to whether there is equality (ratio of one) between them, in which case the relative response factor for the cars is computed in Step 7. Otherwise, if the hall call registration time is greater than the past five minute average waiting time, then the assigned bonuses and penalties for each car is decreased in Step 6 by the values of Table 2. It is again noted that the particular set of decreases in the values of the bonuses and penalties assigned in the preferred, exemplary embodiment is further based on how much greater the hall call registration time is than the past five minute average waiting time (ratios greater than one). This latter is determined in a sub-routine not illustrated for simplicity purposes, the details of which would be known to one of ordinary skill in the art.

In either event, the combination of bonuses and penalties for RSR is then computed for each car in Step 7, following, for example, the methodology of the '381 Bittar et al patent (note particularly FIGS. 6–12 of that patent), and, in a similar fashion, the car with the lowest RSR is selected for that hall call.

For each "down" hall call, starting from the topmost floor, Steps 3 through 8, inclusive, are repeated, to assign all of the "down" hall calls to respective cars, in like fashion to that described above with respect to the "up" hall calls. This then ends, in Step 10, one cycle of assigning all of the hall calls that then existed during the cycle.

The algorithm of FIG. 3 thus provides a suitable assignment means for the assignments of all of the "up" and "down" hall calls are thus completed in each cycle. After which the algorithm of FIG. 3 is repeated over and over again, resulting in the hall calls being dynamically assigned and possible reassigned in each cycle to the car having the lowest RSR value for that call during that cycle.

The algorithm of the present invention thus is used to combine the RSR with variable bonuses and penalties based on a measure of traffic intensity.

The electronic circuitry and components to achieve the foregoing are well established and known in the art and is subject to great variation, the details of which are not part of the present invention.

Exemplary Variants

In another version or embodiment of the variable bonuses and penalties algorithm used in the invention, the values of the bonuses and penalties are decreased or increased based on the difference between the current hall call registration time and the past, for example, five (5) minute average hall call waiting time, as, for example, is determined in the formulations below, rather than based on their ratio(s), as a measure of relatively current traffic intensity.

With the total number of hall calls answered during a one minute interval being "$N_{HCAt}$", where "t" is the specified one minute interval; and With the hall call registration time for a hall call that is answered being "$t_{HCRt}$" when it is answered; and With the total hall call waiting time of all hall calls answered during the one minute interval, "t", being "$T_{HCRtY}$"; and With "t" being the current one minute interval;

Then the five minute average waiting time of all hall calls answered can be expressed as follows:

$$t_{HCW} = \frac{\sum_{t=t-1}^{t-5} T_{HCRt}}{\sum_{t=t-1}^{t-5} N_{HCAt}}$$

If the data have been collected for less than five (5) minutes, then:

$$t_{HCW} = \frac{\sum_{t=1}^{t-1} T_{HCRt}}{\sum_{t=1}^{t-1} N_{HCAt}}$$

In the exemplary embodiment, for each of the hall calls currently pending to be answered, the current hall call registration time "$t_{HCR}$"is computed; the difference between "$t_{HCR}$" and "$t_{HCW}$"is computed; and then the bonuses and penalties used in the RSR algorithm are decreased or increased according to the values shown in Table 3 below.

In a third, somewhat simplified application of the present invention, specifically the process for varying the values of the bonuses and penalties of the present invention previously described, the past five (5) minute average hall call registration or waiting time is computed as before. If this is less than, for example, thirty (30) seconds, as measured by suitable set average hall call waiting time detection means, then it indicates a light traffic load. For such a situation there is no need to use coincident car (CC) calls or contiguous stops (CS). Therefore, the bonuses and penalties are merely reduced "across the board" by, for example, twenty (20%) percent from the nominal values. On the other hand, if the past average five (5) minute hall call waiting time is more than thirty (30) seconds, then the bonuses and penalties are increased by, for example, twenty (20%) percent from the nominal values. Then the corresponding bonuses and penalties are used as the initial values.

The hall calls are assigned to the cars, when they are received, using the initial values of the bonuses and penalties to compute the RSR values. When the hall call is reassigned, the bonuses and penalties used in the RSR calculation are varied from the initial values used by the values shown in Table 3 below.

TABLE 3

| | The Functions Used to Adjust Bonuses and Penalties | | | | | | | | | | |
|---|---|---|---|---|---|---|---|---|---|---|---|
| | Changes in Bonuses and Penalties* | | | | | | | | | | |
| Difference | CCB | CSB | ECP | MGP | UPP | CPP | LCP | LRP | LAP | PAB | FCP |
| ($t_{HCW} - t_{HCR}$) | | | | | | | | | | | |
| >15 + 5 | +5 | +10 | +10 | +5 | +5 | +5 | +5 | +5 | +5 | +5 | +5 |
| >10, ≦15 | +4 | +4 | +8 | +8 | +4 | +4 | +4 | +4 | +4 | +4 | +4 |
| >6, ≦10 | +3 | +3 | +6 | +6 | +3 | +3 | +3 | +3 | +3 | +3 | +3 |
| >3, ≦6 | +2 | +2 | +3 | +3 | +2 | +2 | +2 | +2 | +2 | +2 | +2 |
| >1, ≦3 | +1 | +1 | +1 | +1 | +1 | +1 | +1 | +1 | +1 | +1 | +1 |
| ($t_{HCR} - t_{HCW}$) | | | | | | | | | | | |
| ≧2, <5 | −2 | −1 | −1 | −1 | −1 | −1 | −1 | −1 | −1 | −1 | −1 |
| ≧5, <10 | −4 | −2 | −4 | −4 | −2 | −2 | −3 | −1 | −3 | −2 | −2 |
| ≧10, <15 | −6 | −4 | −5 | −5 | −2 | −2 | −4 | −2 | −4 | −3 | −4 |
| ≧15, <20 | −8 | −6 | −6 | −6 | −3 | −3 | −6 | −3 | −6 | −5 | −6 |
| ≧20, <30 | −10 | −8 | −8 | −8 | −4 | −4 | −8 | −3 | −8 | −6 | −8 |
| ≧30 | −15 | −10 | −8 | −8 | −4 | −4 | −10 | −3 | −10 | −8 | −10 |

*The changes are from the nominal values specified.

The meanings of "CCB", "CSB", "ECP", "MGP", "UPP", "CPP" and "LCP" are as before, while "LRP" is the penalty for a lobby registered call, "LAP" is the penalty for a lobby assigned car, "PAB" is the bonus for a previously assigned car, and "FCP" is the penalty for a full car.

As can be noted from the table, the amount of increase or decrease for each of the bonuses and penalties varies depending on the amount of difference between a preselected hall call registration time and the past selected period's (e.g. five minutes) average hall call waiting time, as a measure of perceived relatively current traffic intensity. Additionally, as can be seen from Table 3, for positive differences, the values of the assigned bonuses and penalties are decreased, while, for negative differences, the values of the assigned bonuses and penalties are increased.

The algorithm of the present invention thus again is used to combine the RSR with variable bonuses and penalties for hall call car assignment based on a perceived measure of traffic intensity of the elevator system, in this embodiment the relationship being the difference between the two selected time factors.

If desired, a computer based simulator can be used to refine the specific, exemplary changes or variations in bonuses and penalties presented in the exemplary Table 3, so that optimal bonuses and penalties can be arrived at for different traffic conditions and elevator applications.

It should be noted that in Tables 1–3 the exemplary variations are not linear. However, they can be made linearly variable, if so desired.

Although the invention has been shown and described with respect to exemplary detailed embodiments thereof, it should be understood that many changes may be made without departing from the spirit and scope of the invention. For example, all of the variations in the relative system response factors, whether they be variations in penalties or bonuses, may be varied widely from those of the tables, proving any desired, variable scheme of system response.

I claim:

1. An elevator system, having a group of elevators for servicing a plurality of floor landings in a building, including group controller means, said group controller means further including signal processing means responsive to said signals indicative of conditions of each of said cars for providing, for each car, with respect to each hall call registered, a signal representing the summation of relative system response factors, indicative of the relative degree to which the assigning of any hall call to said car is in accordance with a scheme of overall system response applicable to all of said cars, wherein the response factors identify different routines to dispatch a car to answer the hall call, each of said relative system response factors being weighted with respect to other response factors to represent an increase in time expected for said group to answer the hall call by following one dispatching routine as opposed to another routine and for assigning each registered hall call to the car provided with the lowest summation of relative system response factors with respect to such hall call for service to such hall call, so that the call assignment is made to the car under a dispatching routine that provides the best overall system response as opposed to the routine achieving the quickest response to the registered hall call; characterized by said signal processing means further comprising:

traffic intensity measurement means for measuring the current traffic intensity of the elevator system; and varying bonus and penalty assignment means associated with said traffic intensity measurement means for varying the assigned bonuses and penalties for said weighted relative system response factors for each car based on the current traffic intensity of the elevator system as measured by said traffic intensity measurement means, with the amounts of the bonuses and penalties being assigned to the elevator cars being varied as the traffic intensity measurements vary, the hall call assignment being made to the selected car by said varying bonus and penalty assignment means providing an improved overall system response for the hall calls with varying traffic intensity.

2. The elevator system of claim 1, further characterized in that the signal processing means comprises:

time selection means for selecting a past time period for evaluating the past average hall call waiting time;

hall call time registration means for recording the time a hall call is placed; and averaging means for averaging the hall car waiting time over the selected past time period, said traffic intensity measurement means utilizing the elapsed time since registration of a hall call and said past average waiting time to measure said traffic intensity; and wherein:

said varying bonus and penalty assignment means of said signal processing means for varying the assigned bonuses and penalties for said weighted relative system response factors for each car includes a signal representing a selected relationship between the hall call registration time and the average hall call waiting time for the selected past time period.

3. The elevator system according to claim 2, further characterized by:

said selected relationship being the ratio of said hall call registration time to said average hall call waiting time for the selected past time period.

4. The elevator system of claim 3, wherein:

the selected past time period is of the order of about five minutes.

5. The elevator system of either claim 3 or 4, characterized by said signal processing means further comprises:

means for increasing the values of the assigned bonuses and penalties, for ratios of said hall call registration time to said average hall call waiting time for the selected past time period less than about one, and decreasing the values of the assigned bonuses and penalties, for ratios of said hall call registration time to said average hall call waiting time for the selected past time period more than about one.

6. The elevator system according to claim 2, further characterized by:

said selected relationship being the difference between said hall call registration time and said average hall call waiting time for the selected past time period.

7. The elevator system of claim 6, wherein:

the selected past time period is of the order of about five minutes.

8. The elevator system of claim 6, wherein, for negative differences the values of the assigned bonuses and penalties are increased, and wherein, for positive differences the values of the assigned bonuses and penalties are decreased.

9. The elevator system of claim 2, further characterized in that the signal processing means comprises:

set average hall call waiting time detection means for detecting when a set amount of hall call waiting time has occurred, below which set point light traffic conditions are considered to be present, during which time relative system response factors are decreased across the board a like amount, and above which set point relatively heavy traffic conditions are considered to be present, during which time relative system response factors are increased across the board a like amount; and set hall call registration time detection means for detecting when a set amount of hall call registration time has occurred, a hall call, once assigned to a car being maintained with that car until said set hall call registration time detection means detects said set amount of time passage, after which point the assignment of the hall call is reevaluated with said varying bonus and penalty assignment means varying the amount of the bonus and penalty values being assigned to said relative system response factors.

10. The elevator system of claim 9, wherein:

said set amount of average hall call waiting time is of the order of about thirty seconds.

11. The elevator system of any one of claims 3, 6 or 9, wherein:

at least some of the factors to which said varying bonuses and penalties are assigned include whether the car has a coincident call, a contiguous stop, a relatively large number of calls already recorded, its motor generator off, is unassigned and parked, parked, and is located at the main landing of the building, such as its lobby.

12. A group controller means for an elevator system, which system has a group of elevator cars for servicing a plurality of floor landings in a building at which hall calls can be placed, the group controller means including signal processing means responsive to signals indicative of conditions of each of the cars for providing, for each car, with respect to each hall call registered, a signal representing the summation of relative system response factors, indicative of the relative degree to which the assigning of any hall call to said car is in accordance with a scheme of overall system response applicable to the cars, wherein the response factors identify different routines to dispatch a car to answer the hall call, each of the relative system response factors being weighted with respect to other response factors to represent an increase in time expected for the group of cars to answer the hall call by following one dispatching routine as opposed to another routine and for assigning each registered hall call to the car provided with the lowest summation of relative system response factors with respect to such hall call for service to such hall call, so that the call assignment is made to the car under a dispatching routine that provides the best overall system response as opposed to the routine achieving the quickest response to the registered hall call; characterized in that said signal processing means further comprises:

(a) measuring means for measuring the current traffic intensity for the cars of the elevator system;

(b) varying bonus and penalty means for providing a set of different bonus and penalties values for the relative system response factors;

(c) assignment means for assigning a selected set of different bonus and penalties values for the relative system response factors from said varying bonus and penalty means based on the measurement of the current traffic intensity for the cars from said measuring means; and (d) further assignment means for thereafter assigning the hall call to the car with the lowest relative system response value.

13. The group controller means of claim 12, characterized in that said signal processing means comprises:

averaging means for averaging the hall car waiting times over a selected, recent past time period;

time measuring means for measuring the hall call registration time for the hall call being considered for assignment; and comparison means for comparing the hall call registration time to the average hall call waiting time.

14. The group controller means of claim 13, characterized in that said signal processing means comprises:

calculating means for calculating the ratio of said hall call registration time to said average hall call waiting times; and selection means for selecting at least in part increasing sets of values of bonuses and penalties, for relatively small, decreasing ratio values, and selecting at least in part decreasing sets of values of bonuses and penalties, for those relatively large, increasing ratio values.

15. The group controller means of claim 13, characterized in that said signal processing means further comprises:

calculation means for calculating the difference between said hall call registration time and said average hall call waiting time; and selection means for selecting at least in part decreasing sets of values of bonuses and penalties, for those relatively large, increasingly positive differences, and selecting at least in part increasing sets of values of bonuses and penalties, for those relatively large, increasingly negative differences.

16. The group controller means of claim 13, characterized in that said signal processing means comprises detection means to:

utilize set average hall call waiting time detection means for detecting when a set amount of average hall call waiting time has passed, below which set point relatively light traffic conditions are considered to be present, and, during which time decreasing selected relative system response factors across the board a like amount in assigning a hall call to a car; and above which set point relatively heavy traffic conditions are considered present, and, during which time increasing the relative system response factors a like amount in assigning a hall call to a car; and utilize set hall call registration time detection means for detecting when a set amount of hall call registration time has passed, maintaining a hall call, once assigned to a car, with that car until said set hall call registration time detection means detects said set amount of time passage, after which point the hall call is reevaluated for assignment utilizing varying bonus and penalty assignment means to vary the amount of the bonus and penalty values being assigned to said relative system response factors.

17. In a method of operation for a group controller means for an elevator system, which system has a group of elevator cars for servicing a plurality of floor landings in a building at which hall calls can be placed, the group controller means including signal processing means responsive to signals indicative of conditions of each of the cars for providing, for each car, with respect to each hall call registered, a signal representing the summation of relative system response factors, indicative of the relative degree to which the assigning of any hall call to said car is in accordance with a scheme of overall system response applicable to the cars, wherein the response factors identify different routines to dispatch a car to answer the hall call, each of the relative system response factors being weighted with respect to other response factors to represent an increase in time expected for the group of cars to answer the hall call by following one dispatching routine as opposed to another routine and for assigning each registered hall call to the car provided with the lowest summation of relative system response factors with respect to such hall call for service to such hall call, so that the call assignment is made to the car under a dispatching routine that provides the best overall system response as opposed to the routine achieving the quickest response to the registered hall call; the method of enhancing the overall system response of the group controller means for assigning the hall calls in the elevator system to the elevator cars in the system, comprising the following steps:

(a) measuring the current traffic intensity for the cars of the elevator system;

(b) providing a set of different bonus and penalties values for each of the relative system response factors;

(c) assigning a selected set of different bonus and penalties values for the relative system response factors from the set of step "b" for the cars being evaluated based on the traffic intensity measured in step "a"; and (d) thereafter assigning the hall call to the car with the lowest relative system response value.

18. The method of claim 17, wherein in step "a" there is included the following steps:

(a-i) averaging the hall car waiting times over a selected, recent past time period;

(a-ii) measuring the hall call registration time for the hall call being considered for assignment; and (a-iii) comparing the hall call registration time to the average hall call waiting time.

19. The method of claim 18, wherein in step "a-iii" there is included the following step(s):

calculating the ratio of said hall call registration time to said average hall call waiting times; and wherein for step "b" there is included the following step(s):

for those relatively small, decreasing ratio values, selecting at least in part increasing sets of values of bonuses and penalties, while, for those relatively large, increasing ratio values, selecting at least in part decreasing sets of values of bonuses and penalties.

20. The method of claim 18, wherein in step "a-iii" there is included the following step(s):

calculating the difference between said hall call registration time and said average hall call waiting time; and wherein for step "b" there is included the following step(s):

for those relatively large, increasingly positive differences, selecting at least in part decreasing sets of values of bonuses and penalties, while, for those relatively large, increasingly negative differences, selecting at least in part increasing sets of values of bonuses and penalties.

21. The method of claim 18, wherein in step "a-iii" there is included the following step(s):

utilizing set average hall call waiting time detection means for detecting when a set amount of average hall call waiting time has passed, and, during which set time, decreasing relative system response factors across the board a like amount in assigning a hall call to a car, and after which set time, increasing the relative system response factors a like amount in assigning a hall call to a car; and utilizing set hall call registration time detection means for detecting when a set amount of hall call registration time has passed, maintaining a hall call, once assigned to a car, with that car until said set hall call registration time detection means detects said set amount of time passage, after which point the hall call is reevaluated for assignment utilizing varying bonus and penalty assignment means to vary the amount of the bonus and penalty values being assigned to said relative system response factors.

* * * * *